US009828648B2

(12) United States Patent
Kizu et al.

(10) Patent No.: US 9,828,648 B2
(45) Date of Patent: Nov. 28, 2017

(54) STEEL SHEET WITH EXCELLENT AGING RESISTANCE PROPERTY AND METHOD FOR PRODUCING THE SAME

(71) Applicant: JFE STEEL CORPORATION, Chiyoda-ku, Tokyo (JP)

(72) Inventors: Taro Kizu, Kawasaki (JP); Koichiro Fujita, Nagoya (JP)

(73) Assignee: JFE STEEL CORPORATION, Tokyo (JP)

( * ) Notice: Subject to any disclaimer, the term of this patent is extended or adjusted under 35 U.S.C. 154(b) by 533 days.

(21) Appl. No.: 14/363,977

(22) PCT Filed: Dec. 10, 2012

(86) PCT No.: PCT/JP2012/007870

§ 371 (c)(1),
(2) Date: Jun. 9, 2014

(87) PCT Pub. No.: WO2013/088692

PCT Pub. Date: Jun. 20, 2013

(65) Prior Publication Data

US 2014/0366994 A1 Dec. 18, 2014

(30) Foreign Application Priority Data

Dec. 12, 2011 (JP) ..... 2011-270937

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/14*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/60*** | (2006.01) |

(52) U.S. Cl.

CPC ..... *C21D 8/0263* (2013.01); *C21D 8/0205* (2013.01); *C21D 8/0236* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/24* (2013.01); *C22C 38/26* (2013.01); *C22C 38/28* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/60* (2013.01); *C21D 2211/004* (2013.01); *C21D 2211/005* (2013.01)

(58) Field of Classification Search

CPC ..... C21D 8/02; C22C 38/54

See application file for complete search history.

(56) References Cited

U.S. PATENT DOCUMENTS

| | | | | |
|---|---|---|---|---|
| 6,221,180 | B1 * | 4/2001 | Tosaka | C21D 8/0273 148/320 |
| 7,485,195 | B2 * | 2/2009 | Sugiura | C21D 8/0226 148/320 |
| 2010/0116832 | A1 * | 5/2010 | Nishihara | C21D 9/46 220/669 |

FOREIGN PATENT DOCUMENTS

| | | |
|---|---|---|
| CN | 101921951 | 12/2010 |
| CN | 101643828 | 5/2011 |
| EP | 2586855 | 5/2013 |
| JP | 03130345 | 6/1991 |
| JP | 055156 | 1/1993 |
| JP | 08319538 | 12/1996 |
| JP | 10265899 | 10/1998 |
| JP | 10317094 | 12/1998 |
| JP | 2000328186 | 11/2000 |
| JP | 2007009272 | 1/2007 |

(Continued)

OTHER PUBLICATIONS

Extended European Search Report for European Patent Application No. 12858474.5-1362 dated Oct. 16, 2014.

(Continued)

*Primary Examiner* — Jonathan Johnson
*Assistant Examiner* — Christopher Kessler
(74) *Attorney, Agent, or Firm* — RatnerPrestia

(57) ABSTRACT

A steel sheet and a method for producing the same are disclosed. The steel sheet has a composition containing 0.015% to 0.05% C, less than 0.10% Si, 0.1% to 2.0% Mn, 0.20% or less P, 0.1% or less S, 0.01% to 0.10% Al, 0.005% or less N, and 0.06% to 0.5% Ti in percent by mass, C and Ti satisfying the inequality Ti*/C≥4, where Ti* (mass percent)=Ti−3.4N and Ti, C, and N represent the content (mass percent) of each element. The steel sheet has a microstructure which contains a ferrite phase as a base, in which the average grain diameter of the ferrite phase is 7 μm or more, and in which the ratio of the rolling-direction average grain diameter to thickness-wise average grain diameter of the ferrite phase is 1.1 or more.

10 Claims, 1 Drawing Sheet

(56) References Cited

FOREIGN PATENT DOCUMENTS

| | | |
|---|---|---|
| JP | 2009024226 | 2/2009 |
| JP | 2009263715 | 11/2009 |
| JP | 2011012308 | 1/2011 |
| JP | 201121224 | 2/2011 |
| JP | 2011038154 | 2/2011 |

OTHER PUBLICATIONS

International Search Report for PCT/JP2012/007870 dated Feb. 19, 2013, including English translation.
Written Opinion of the International Searching Authority for International Application No. PCT/JP2012/007870, including English translation.

* cited by examiner

STEEL SHEET WITH EXCELLENT AGING RESISTANCE PROPERTY AND METHOD FOR PRODUCING THE SAME

CROSS REFERENCE TO RELATED APPLICATIONS

This is the U.S. National Phase application of PCT/JP2012/007870, filed Dec. 10, 2012, which claims priority to Japanese Patent Application No. 2011-270937, filed Dec. 12, 2011, the disclosures of each of these applications being incorporated herein by reference in their entireties for all purposes.

FIELD OF THE INVENTION

Aspects of the present invention relate to a steel sheet suitable for pressure vessels for compressors and the like or containers for alkali batteries, Li batteries, and the like and particularly relates to the improvement of an aging resistance property.

BACKGROUND OF THE INVENTION

In recent years, the following sheet has been developed and has been used for various applications such as vessels: an IF (interstitial free) steel sheet, in which the content of C is reduced to tens of parts per million by vacuum degassing and which is made free from solutes C and N by adding a trace amount of a carbonitride-forming element such as Ti, Nb, or the like. The IF steel sheet, which is free from solutes C and N, does not have age-hardenabilty and has excellent workability. Therefore, in many cases, the IF steel sheet is used as a steel sheet for vessels, which is required to have high formability including drawing. However, reducing the content of C in molten steel increases the amount of dissolved oxygen as described in Patent Literature 1 and therefore there is a problem that the amount of inclusions such as alumina is increased.

From the viewpoint of global environmental conservation and the like, demands for reducing the amount of steel used by the gauge reduction of steel sheets are recently growing. If the gauge of the IF steel sheet is reduced in accordance with such demands, then inclusions are likely to appear on the surface thereof and a problem that defects are likely to extend through the steel sheet occurs in the case of an extremely thin material. On the other hand, in low-carbon steel sheets (since the content of C is not extremely reduced, the amount of inclusions is small and the problem that inclusions are likely to appear on the surface does not occur), age hardening occurs to reduce the formability thereof and therefore problems such as press cracking are likely to occur during gauge reduction.

Therefore, a low-carbon steel sheet which contains a few inclusions and which does not have age-hardenabilty is strongly demanded in association with the gauge reduction of such steel sheets.

For such a demand, for example, Patent Literature 1 discloses a high-strength steel sheet for forming. The high-strength steel sheet contains, in percent by mass, C: 0.01% to less than 0.1%, Si: 0.1% to 1.2%, Mn: 3.0% or less, Ti: the ratio (effective *Ti)/C being 4 to 12, B: 0.0005% to 0.005%, Al: 0.1% or less, P: 0.1% or less, S: 0.02% or less, and N: 0.005% or less, where effective *Ti is defined by the equation effective *Ti=Ti−1.5S−3.43N. According to a technique disclosed in Patent Literature 1, even in a low-C steel sheet in which the content of C is increased, by allowing a large amount of Si to be contained thereby promoting elimination of C from ferrite, and by adjusting the ratio effective *Ti/C to 4 to 12, solutes C, N, S, and the like can be completely fixed, the in-plane anisotropy is small, the yield ratio is low, aging is completely suppressed, and softening by high-temperature heating can be prevented.

Patent Literature 2 discloses a steel sheet which contains, in percent by mass, C: 0.0080% to 0.0200%, Si: 0.02% or less, Mn: 0.15% to 0.25%, Al: 0.065% to 0.200%, N: 0.0035% or less, and Ti: $0.5 \leq (Ti-(48/14)N-(48/32)S)/(48/12)C) \leq 2.0$. The steel sheet has an average grain diameter of 20.0 μm or less and low anisotropy. According to a technique disclosed in Patent Literature 2, the following sheet is obtained: a steel sheet in which the cold-rolling ratio dependence of Δr which is an indicator for in-plane anisotropy is low and the change in Δr due to variations in production conditions is small.

[PTL 1] Japanese Unexamined Patent Application Publication No. 5-5156

[PTL 2] Japanese Unexamined Patent Application Publication No. 2007-9272

NPL 1: The Japan Institute of Metals, *Kinzoku Kagaku Nyumon Shirizu* 2 Tekko Seiren, p. 195, July 2000

SUMMARY OF THE INVENTION

However, in the technique disclosed in Patent Literature 1, although the elimination of C from ferrite is promoted and Ti carbides are precipitated in a ferrite region, there is a problem in that the steel sheet is hardened and the increase in strength thereof is significant particularly after aging because the Ti carbides precipitated in the ferrite region are fine and are precipitated coherently to the matrix. Furthermore, in the technique disclosed in Patent Literature 2, there is a problem in that Ti carbides are finely precipitated, the strength is significantly increased after aging, and the formability is reduced.

It is an object of aspects of the present invention to solve the conventional technical problems and to provide a steel sheet having an excellent aging resistance property and a method for producing the same. A steel sheet according to aspects of the present invention may have various thicknesses and can be preferably applied to an extremely thin steel sheet with a thickness of, for example, 0.5 mm or less.

The inventors have intensively investigated various factors affecting an aging resistance property for the purpose of achieving the above object. As a result, the inventors have found that coarse precipitation during hot rolling increases the aspect ratio of ferrite grains, that is, the ratio $d_L/d_t$ of the rolling-direction average grain diameter $d_L$ to the thickness-wise average grain diameter $d_t$ and, as a result, the aging resistance property is significantly enhanced. That is, the inventors have found that the aging index AI can be adjusted to, for example, 10 MPa or less in such a way that the ratio $d_L/d_t$ of the rolling-direction average grain diameter $d_L$ to thickness-wise average grain diameter $d_t$ of the ferrite grains is adjusted to 1.1 or more.

First, results of experiments conducted by the inventors are described.

Slabs having a composition containing 0.015% to 0.055% C, 0.01% to 0.10% Si, 0.1% to 2.0% Mn, 0.01% to 0.20% P, 0.01% to 0.05% S, 0.01% to 0.12% Al, 0.05% to 0.55% Ti, and 0.001% to 0.005% N in percent by mass, the ratio of Ti to C being adjusted, were subjected to hot rolling including rough rolling and finish rolling under various conditions, whereby hot-rolled sheets with a thickness of 2.0 mm to 4.0 mm were obtained. Subsequently, the obtained hot-rolled sheets were pickled and were then cold-rolled into cold-rolled sheets with a thickness of 0.25 mm to 1.0 mm, followed by soaking under various conditions.

Obtained steel sheets were observed for microstructure and the rolling-direction average grain diameter $d_L$ and thickness-wise average grain diameter $d_t$ of ferrite were determined by a method described in an example. Furthermore, the obtained steel sheets were determined for aging index AI and aged yield stress (determined by a method described in an example). Incidentally, the aging index AI was determined in such a way that a pre-strain of 7.5% was applied to a tensile specimen taken from each obtained steel sheet, the tensile specimen was aged at 100° C. for 30 minutes, and a value was calculated by subtracting the 7.5% pre-strained strength (stress) from the aged yield stress.

Obtained results are shown in FIGS. 1 and 2.

As is clear from FIG. 1, the aging index AI can be adjusted to 10 MPa or less by adjusting the ratio $d_L/d_t$ to 1.1 or more. As is clear from FIG. 2, the aged yield stress can be adjusted to 400 MPa or less by adjusting the ratio $d_L/d_t$ to 1.1 or more.

The following mechanism has been unclear until now: a mechanism in which the increase of the aged strength can be suppressed or the aging index AI can be adjusted to 10 MPa or less by adjusting the ratio $d_L/d_t$ to 1.1 or more. However, the inventors regard the mechanism as described below.

Since coarsening precipitates (TiC) does not inhibit the growth of ferrite grains particularly in the rolling direction (the density of precipitates is low as compared to the thickness direction), the ratio $d_L/d_t$ of the rolling-direction average grain diameter $d_L$ to thickness-wise average grain diameter $d_t$ of the ferrite grains can be increased. Increasing the ratio $d_L/d_t$ of the ferrite grains allows strain to be concentrated in the thickness direction during the application of strain and also allows the increase of the yield stress in a tensile direction (rolling direction) to be small after aging, resulting in that the aging index AI can be reduced.

The present invention has been completed on the basis of the above findings in addition to further investigations. That is, aspects of the present invention is as described below.

(1) A steel sheet with an excellent aging resistance property has a composition containing 0.015% to 0.05% C, less than 0.10% Si, 0.1% to 2.0% Mn, 0.20% or less P, 0.1% or less S, 0.01% to 0.10% Al, 0.005% or less N, and 0.06% to 0.5% Ti in percent by mass, the remainder comprising Fe and inevitable impurities, C and Ti satisfying the following inequality:

$$Ti^*/C \geq 4 \quad (1)$$

where $Ti^*=Ti-3.4N$ and Ti, C, and N represent the content (mass percent) of each element.

The steel sheet has a microstructure which contains a ferrite phase as a base, in which the average grain diameter of the ferrite phase is 7 μm or more, and in which the ratio $d_L/d_t$ of the rolling-direction average grain diameter $d_L$ to thickness-wise average grain diameter $d_t$ of the ferrite phase is 1.1 or more. The steel sheet has a rolling-direction AI (aging index) value of 10 MPa or less. The rolling-direction AI value is defined as a value which is obtained in such a way that after a tensile specimen is taken such that a rolling direction coincides with a tensile direction, a pre-strain of 7.5% is applied to the tensile specimen, and the tensile specimen is aged at 100° C. for 30 minutes, the 7.5% pre-strained stress is subtracted from the yield stress.

(2) The steel sheet with an excellent aging resistance property specified in Item (1) further contains 0.0005% to 0.0050% B in percent by mass in addition to the above composition.

(3) The steel sheet with an excellent aging resistance property specified in Item (1) or (2) further contains at least one selected from the group consisting of 0.005% to 0.1% Nb, 0.005% to 0.1% V, 0.005% to 0.1% W, 0.005% to 0.1% Mo, and 0.005% to 0.1% Cr in percent by mass in addition to the above composition.

(4) The steel sheet with an excellent aging resistance property specified in any one of Items (1) to (3) further contains at least one selected from the group consisting of 0.01% to 0.1% Ni and 0.01% to 0.1% Cu in percent by mass in addition to the above composition.

(5) The steel sheet with an excellent aging resistance property specified in Items any one of (1) to (4) is a thin steel sheet with a thickness of 0.5 mm or less.

(6) The steel sheet with an excellent aging resistance property specified in any one of Items (1) to (5) includes a surface plating layer.

(7) A method for producing a steel sheet with an excellent aging resistance property includes heating a steel material and subjecting the steel material to hot rolling including rough rolling and finish rolling to prepare a hot-rolled sheet. The steel material has a composition containing 0.015% to 0.05% C, less than 0.10% Si, 0.1% to 2.0% Mn, 0.20% or less P, 0.1% or less S, 0.01% to 0.10% Al, 0.005% or less N, and 0.06% to 0.5% Ti in percent by mass, the remainder comprising Fe and inevitable impurities, C and Ti satisfying the following inequality:

$$Ti^*/C \geq 4 \quad (1)$$

where $Ti^*=Ti-3.4N$ and Ti, C, and N represent the content (mass percent) of each element.

The hot rolling is performed such that the holding time in a temperature range of 900° C. to 950° C. is 3 seconds or more. The finish rolling is performed such that rolling is completed at a finishing delivery temperature not lower than the $Ar_3$ transformation temperature. The hot-rolled sheet is cooled at an average cooling rate of 50° C./sec. or less after the completion of the finish rolling and is then coiled at a coiling temperature of 600° C. or higher.

(8) In the method for producing the steel sheet with an excellent aging resistance property specified in Item (7), the steel material further contains 0.0005% to 0.0050% B in percent by mass in addition to the above composition.

(9) In the method for producing the steel sheet with an excellent aging resistance property specified in Item (7) or (8), the steel material further contains at least one selected from the group consisting of 0.005% to 0.1% Nb, 0.005% to 0.1% V, 0.005% to 0.1% W, 0.005% to 0.1% Mo, and 0.005% to 0.1% Cr in percent by mass in addition to the above composition.

(10) In the method for producing the steel sheet with an excellent aging resistance property specified in any one of Items (7) to (9), the steel material further contains at least one selected from the group consisting of 0.01% to 0.1% Ni and 0.01% to 0.1% Cu in percent by mass in addition to the above composition.

(11) In the method for producing the steel sheet with an excellent aging resistance property specified in any one of Items (7) to (10), the rough rolling of the hot rolling is such rolling that the cumulative rolling reduction is 80% or more and the finishing rolling temperature is 1,150° C. or lower.

(12) In the method for producing the steel sheet with an excellent aging resistance property specified in any one of Items (7) to (11), the hot-rolled sheet further is pickled and is cold-rolled into a cold-rolled sheet and the cold-rolled sheet is soaked at a soaking temperature of 650° C. to 850° C. for 10 seconds to 300 seconds.

(13) In the method for producing the steel sheet with an excellent aging resistance property specified in any one of Items (7) to (12), the steel sheet is further plated. The composition of the steel sheet specified in Items (1) to (4) can be expressed as follows: "a composition containing 0.015% to 0.05% C, less than 0.10% Si, 0.1% to 2.0% Mn, 0.20% or less P, 0.1% or less S, 0.01% to 0.10% Al, 0.005% or less N, and 0.06% to 0.5% Ti in percent by mass; optionally containing 0.0005% to 0.0050% B in percent by mass; optionally containing at least one of 0.005% to 0.1% Nb, 0.005% to 0.1% V, 0.005% to 0.1% W, 0.005% to 0.1% Mo, and 0.005% to 0.1% Cr in percent by mass; and optionally containing at least one of 0.01% to 0.1% Ni and 0.01% to 0.1% Cu, the remainder comprising Fe and inevitable impurities, C and Ti satisfying the following inequality:

$$Ti^*/C \geq 4 \quad (1)$$

where $Ti^*=Ti-3.4N$ and Ti, C, and N represent the content (mass percent) of each element".

This applies to the composition of the steel material specified in Items (7) to (10).

According to aspects of the present invention, a steel sheet having an aging index AI of 10 MPa or less, that is, an excellent aging resistance property can be readily produced at low cost. This provides industrially remarkable effects. Furthermore, according to aspects of the present invention, there is an effect that a steel sheet having an aged yield stress of 400 MPa or less, a small increase in aged strength, and a small reduction in formability can be obtained.

DETAILED DESCRIPTION OF THE INVENTION

Figure 1:
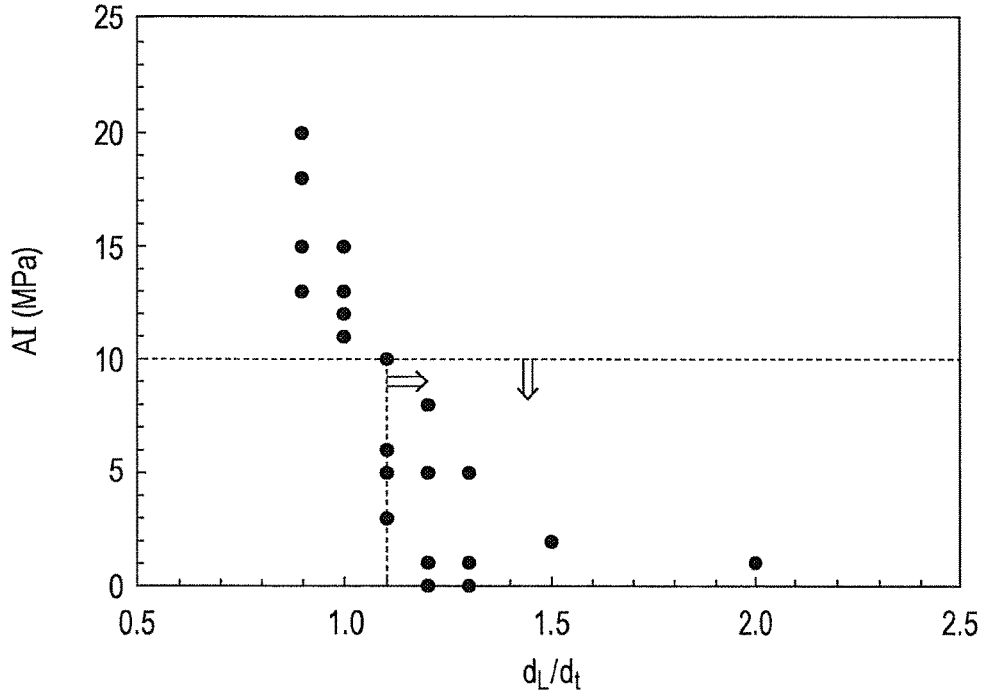
FIG. 1 is a graph showing the influence of the ratio $d_L/d_t$ of the rolling-direction average grain diameter $d_L$ to thickness-wise average grain diameter $d_t$ of ferrite grains on the aging index AI.
Figure 2:
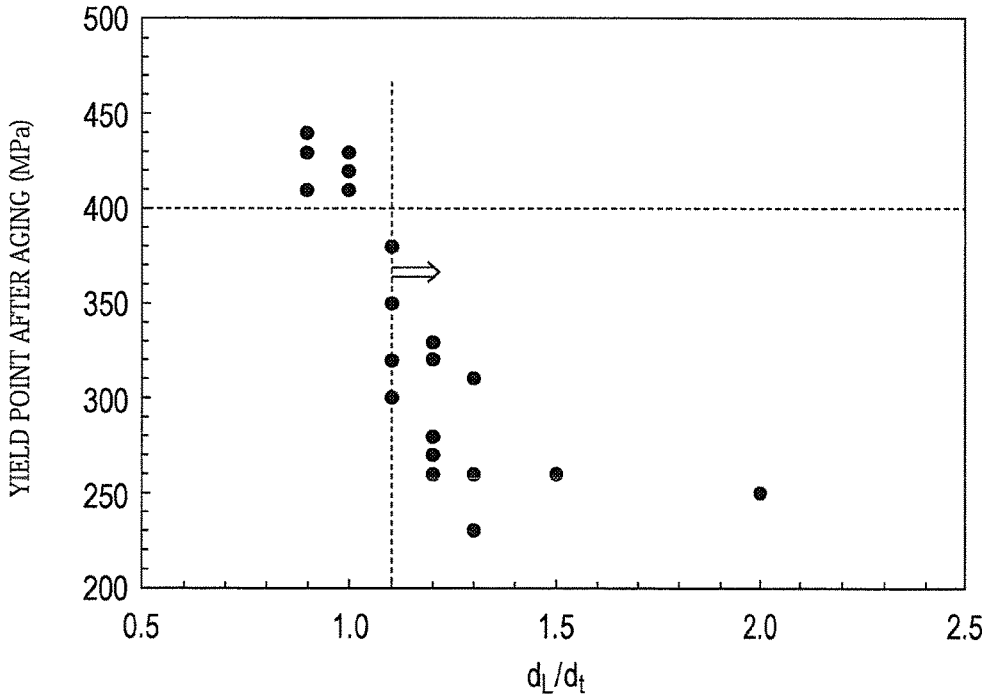
FIG. 2 is a graph showing the influence of the ratio $d_L/d_t$ of the rolling-direction average grain diameter $d_L$ to thickness-wise average grain diameter $d_t$ of ferrite grains on the aged yield stress.

A steel sheet according to aspects of the present invention is a hot-rolled steel sheet, a cold-rolled steel sheet, or a plated steel sheet. The steel sheet is not limited in thickness and can be preferably applied to an extremely thin steel sheet (usually requiring a cold rolling step) with a thickness of, for example, 0.5 mm or less.

First, reasons for limiting the composition of the steel sheet according to aspects of the present invention are described. Mass percent is hereinafter simply referred to as % unless otherwise specified.

C: 0.015% to 0.05%

C has the ability to reduce the amount of dissolved oxygen during refining to suppress the formation of inclusions. Furthermore, C promotes the formation of TiC. In order to achieve such effects, it is necessary to contain 0.015% or more C. However, containing more than 0.05% C hardens the steel sheet. Furthermore, when C is present in the form of solute C, age hardening is promoted. Therefore, the content of C is limited to a range of 0.015% to 0.05%. Incidentally, the C content is preferably 0.02% to 0.035%.

Si: less than 0.10%

When the steel sheet contains a large amount of Si, the steel sheet is hardened and is reduced in press formability. Si forms Si oxide coatings during annealing to reduce the wettability. Furthermore, Si increases the austenite (γ) to ferrite (α) transformation temperature during hot rolling and therefore precipitation of TiC in a γ-region becomes difficult. Therefore, the content of Si is limited to less than 0.10%. Incidentally, the Si content is preferably 0.05% or less, more preferably 0.04% or less, further more preferably 0.03% or less, and still further more preferably 0.02% or less. There is no problem if Si is not contained.

Mn: 0.1% to 2.0%

Mn has the ability to fix S, which is harmful, in steel in the form of MnS to suppress the adverse influence of S. Furthermore, Mn forms a solid solution to harden steel and has the ability to stabilize austenite (γ). In order to achieve such effects, it is necessary to contain 0.1% or more Mn. However, containing a large amount of Mn, that is, more than 2.0% Mn increases bainite and/or martensite during cooling to harden the steel sheet, thereby reducing the press formability. Therefore, the content of Mn is limited to a range of 0.1% to 2.0%. The Mn content is preferably 1.0% or less, more preferably 0.5% or less, and further more preferably 0.3% or less.

P: 0.20% or less

P segregates at grain boundaries to reduce the ductility and the toughness. Furthermore, P increases the austenite (γ) to ferrite (a) transformation temperature during hot rolling and therefore precipitation of TiC in the γ-region becomes difficult. Therefore, the content of P is preferably minimized and may be up to 0.20%. The P content is preferably 0.1% or less, more preferably 0.05% or less, and further more preferably 0.03% or less. There is no problem if P is not contained.

S: 0.1% or less

S significantly reduces the hot ductility and induces hot roll cracking to significantly reduce surface properties. Furthermore, S hardly contributes to increasing the strength, forms coarse MnS in the form of an impurity, and reduces the ductility and the toughness. Therefore, the content of S is preferably minimized and may be up to 0.1%. The S content is preferably 0.05% or less, more preferably 0.02% or less, and further more preferably 0.01% or less. There is no problem if S is not contained.

Al: 0.01% to 0.10%

Al acts as a deoxidizer. In order to achieve such an effect, it is necessary to contain 0.01% or more Al. However, containing a large amount of Al, that is, more than 0.10% Al increases the austenite (γ) to ferrite (α) transformation temperature during hot rolling and therefore causes difficulty in precipitating TiC in the γ-region. Therefore, the content of Al is limited to a range of 0.01% to 0.10%. Incidentally, the Al content is preferably 0.06% or less and more preferably 0.04% or less.

N: 0.005% or less

N combines with Ti to form TiN, thereby reducing the amount of effective Ti, which is precipitated in the form of Ti carbides. When a large amount of N is contained, slab cracking is induced during hot rolling and therefore many surface scratches may possibly be caused. Therefore, the content of N is limited to 0.005% or less. Incidentally, the N content is preferably 0.003% or less and more preferably 0.002% or less. There is no problem if N is not contained.

Ti: 0.06% to 0.5%

Ti combines with solutes C and N to form Ti carbide and/or nitride and has the ability to suppress age hardening due to solutes C and N. In order to achieve such an effect, it is necessary to contain 0.06% or more Ti. However, containing a large amount of Ti, that is, more than 0.5% Ti causes a significant increase in production cost and increases the austenite (γ) to ferrite (α) transformation temperature during hot rolling to cause difficulty in precipitating TiC in the γ-region. Therefore, the content of Ti is limited to a range of 0.06% to 0.5%. Incidentally, the Ti content is preferably 0.1% to 0.3%, more preferably 0.2% or less, and further more preferably 0.15% or less. Ti is contained within the above range and is adjusted so as to satisfy the following inequality:

$$Ti^*/C \geq 4 \quad (1)$$

where Ti* (mass percent)=Ti−3.4N (where Ti, C, and N represent the content (mass percent) of each element). Ti* represents the amount of Ti that is not precipitated in the form of TiN. When Ti*/C is 4 or more, solute C can be entirely precipitated in the form of TiC and age hardening can be suppressed. The upper limit of Ti*/C is not particularly limited and may be about 10 or less. Incidentally, Ti*/C is preferably 5 or more and more preferably 6 or more.

The above compositions are fundamental compositional patterns. In addition to the fundamental composition, 0.0005% to 0.0050% B; one or more of 0.005% to 0.1% Nb, 0.005% to 0.1% V, 0.005% to 0.1% W, 0.005% to 0.1% Mo, and 0.005% to 0.1% Cr; and/or one or both of 0.01% to 0.1% Ni and 0.01% to 0.1% Cu may be further optionally contained as optional elements.

B: 0.0005% to 0.0050%

B segregates at γ grain boundaries during hot rolling to stabilize the grain boundaries and therefore has the ability to reduce the number of sites producing ferrite nuclei to coarsen the ferrite grains. In order to achieve such an effect, 0.0005% or more B is preferably contained. However, containing more than 0.0050% B significantly suppresses the recrystallization of γ during hot rolling; hence, an increase in hot rolling load is caused and the recrystallization is significantly suppressed during annealing subsequent to cold rolling. When B is contained, the content of B is preferably limited to a range of 0.0005% to 0.0050%. Incidentally, the B content is more preferably 0.0010% to 0.0030% and further more preferably 0.0020% or less.

One or more of 0.005% to 0.1% Nb, 0.005% to 0.1% V, 0.005% to 0.1% W, 0.005% to 0.1% Mo, and 0.005% to 0.1% Cr All of Nb, V, W, Mo, and Cr are carbide-forming elements, contribute to reducing the amount of solute C through the formation of carbides, have the ability to improve an aging resistance property, and may be optionally contained. In order to achieve such effects, 0.005% or more Nb, 0.005% or more V, 0.005% or more W, 0.005% or more Mo, and/or 0.005% or more Cr is preferably contained. However, containing more than 0.1% Nb, more than 0.1% V, more than 0.1% W, more than 0.1% Mo, and/or more than 0.1% Cr hardens the steel sheet to reduce the press formability thereof. Therefore, when Nb, V, W, Mo, and/or Cr is contained, it is preferred that Nb is limited to a range of 0.005% to 0.1%, V is limited to a range of 0.005% to 0.1%, W is limited to a range of 0.005% to 0.1%, Mo is limited to a range of 0.005% to 0.1%, and/or Cr is limited to a range of 0.005% to 0.1%, respectively. Incidentally, it is more preferred that Nb is 0.05% or less, V is 0.05% or less, W is 0.05% or less, Mo is 0.05% or less, and/or Cr is 0.05% or less.

One or both of 0.01% to 0.1% Ni and 0.01% to 0.1% Cu

Both Ni and Cu have the ability to refine a γ-phase during hot rolling to promote the precipitation of TiC in the γ-phase. One or both thereof may be contained as required. In order to achieve such an effect, it is necessary to contain 0.01% or more Ni and/or 0.01% or more Cu. However, containing more than 0.1% Ni and/or more than 0.1% Cu increases the rolling load during hot rolling to significantly reduce production efficiency. Therefore, when Ni and/or Cu is contained, it is preferred that Ni is limited to a range of 0.01% to 0.1% and/or Cu is limited to a range of 0.01% to 0.1%, respectively. Incidentally, it is more preferred that Ni is 0.05% or less and/or Cu is 0.05% or less.

The remainder other than the above components is Fe and inevitable impurities. Incidentally, the inevitable impurities are Sn, Mg, Co, As, Pb, Zn, O, and the like and may be 0.5% or less in total.

Reasons for limiting the microstructure of the steel sheet according to aspects of the present invention are described below.

The steel sheet according to aspects of the present invention has a microstructure containing ferrite, which is soft and is excellent in press formability, as a base. The term "base" as used herein refers to a structure having an area fraction of 95% or more, preferably 98% or more, and more preferably 100% as observed in a cross section of the steel sheet. Incidentally, pearlite, cementite, bainite, martensite, and the like can be exemplified as secondary phases other than ferrite.

In the steel sheet according to aspects of the present invention, ferrite, which is a base, is a phase in which the ratio $d_L/d_t$ of the rolling-direction average grain diameter $d_L$ to the thickness-wise average grain diameter $d_t$ is 1.1 or more. Adjusting the rolling-direction average grain diameter $d_L$ of ferrite to be greater than the thickness-wise average grain diameter $d_t$ of ferrite increases the aging resistance property. This is because adjusting $d_L$ to be greater than $d_t$, that is, adjusting the ratio $d_L/d_t$ to be 1.1 or more, allows more strain to be concentrated in the thickness direction during the application of strain and also allows the increase of yield stress in a tensile direction (rolling direction) to be reduced after aging, resulting in that the aging index AI can be reduced. Incidentally, the ratio $d_L/d_t$ is preferably 1.2 or more, and more preferably 1.3 or more. The upper limit thereof is preferably about 2.0.

In the steel sheet according to aspects of the present invention, ferrite, which is a base, has an average grain diameter of 7 μm or more. The average grain diameter of ferrite is determined in such a way that $2/(1/d_L+1/d_t)$ is calculated from the rolling-direction average grain diameter $d_L$ and thickness-wise average grain diameter $d_t$ of ferrite.

The reduction in average grain diameter of ferrite hardens the steel sheet to reduce the press formability thereof. Therefore, in aspects of the present invention, the average grain diameter of ferrite is limited to 7 μm or more. The upper limit of the average grain diameter of ferrite is not particularly limited. An increase in grain diameter is likely to cause a surface irregular pattern referred to as orange peel during forming. Therefore, the average grain diameter of ferrite is preferably 50 μm or less and more preferably 30 μm or less.

A preferred method for producing the steel sheet according to aspects of the present invention is described below.

In aspects of the present invention, after steel is cast, a cold piece or a warm piece is heated and is then subjected to hot rolling including rough rolling and finish rolling or a hot piece is directly subjected to hot rolling including rough rolling and finish rolling, whereby a hot-rolled sheet is obtained.

A method for producing a steel material need not be particularly limited. It is preferred that refined steel having the above composition is produced by a common method using a converter, an electric furnace, or the like and is then cast into a steel material such as a slab by a common casing process such as a continuous casting process.

The cast steel material is directly hot-rolled when having a temperature sufficient to enable hot rolling or, if not so, a cold piece or a hot piece (or a warm piece) is reheated and is then hot-rolled, whereby a hot-rolled sheet is obtained. Incidentally, the reheating temperature for hot rolling need not be particularly limited and is preferably 1,100° C. to 1,300° C.

When the reheating temperature of the steel material is lower than 1,100° C., the deformation resistance is high and therefore the load applied to a rolling mill is too large to perform desirable hot rolling. However, at a temperature of higher than 1,300° C., scale loss is extremely high and therefore causes a reduction in yield and the coarsening of crystal grains is significant and therefore causes difficulty in ensuring desired properties.

In the method for producing the steel sheet according to aspects of the present invention, hot rolling is such rolling that the holding time in a temperature range of 900° C. to 950° C. is 3 seconds or more in the course of hot rolling.

Holding in a temperature range of 900° C. to 950° C., which is an austenite region, increases the driving force of precipitation of TiC to allow the precipitation of TiC to be promoted. Incidentally, the holding time is 3 seconds or more. The holding time is preferably 5 seconds or more and more preferably 10 seconds or more. Holding in the austenite region may be performed before or during finish rolling in the course of hot rolling. That is, "holding" is sufficient if a predetermined temperature range can be maintained for a predetermined time. Rolling deformation may be caused during the holding.

Rough rolling is sufficient if a sheet bar with a desired size and shape can be ensured. Rough rolling conditions need not be particularly limited. From the viewpoint of promoting the precipitation of TiC in the austenite region, it is preferred that the cumulative rolling reduction of rough rolling is 80% or more and the finishing rolling temperature of rough rolling is 1,150° C. or lower.

Cumulative rolling reduction in rough rolling: 80% or more

Increasing the rolling reduction in rough rolling is likely to cause the strain-induced precipitation of TiC and allows the precipitation of TiC in the austenite region to be promoted. In order to achieve such an effect, the cumulative rolling reduction is preferably 80% or more, more preferably 85% or more, and further more preferably 88% or more. The upper limit of the cumulative rolling reduction in rough rolling is not particularly limited and is preferably 95% or less, which is a range available in an ordinary rough rolling line.

Finishing rolling temperature of rough rolling: 1,150° C. or lower

Reducing the finishing rolling temperature of rough rolling makes the strain-induced precipitation of TiC remarkable and allows the precipitation of TiC in the austenite region to be promoted. In order to achieve such an effect, the finishing rolling temperature is preferably 1,150° C. or lower, more preferably 1,100° C. or lower, and further more preferably 1,050° C. or lower. The finishing rolling temperature is preferably 1,000° C. or higher in association with subsequent finish rolling.

After rough rolling is completed, finish rolling is performed, whereby the hot-rolled sheet is obtained.

Finishing delivery temperature: not lower than $Ar_3$ transformation temperature Finish rolling is completed at a finishing delivery temperature not lower than the $Ar_3$ transformation temperature. When the finishing delivery temperature is lower than the $Ar_3$ transformation temperature, ferrite is produced during rolling to increase the driving force of precipitation of TiC. As a result, the strain-induced precipitation of TiC is caused by strain during rolling and TiC is finely precipitated in ferrite. Therefore, any desired low aging index AI cannot be ensured. The $Ar_3$ transformation temperature used is a value determined from a thermal expansion curve which is obtained in such a way that after compression is performed at 950° C. with a reduction of 50%, cooling is performed at a cooling rate of 10° C./s.

After hot rolling is completed, the hot-rolled sheet is cooled at an average cooling rate of 50° C./sec. or less and is then coiled at a temperature of 600° C. or higher.

Average cooling rate after completion of hot rolling: 50° C./sec. or less

In the case of slowly performing cooling after the completion of hot rolling, TiC can be coarsely precipitated using TiC precipitated in the austenite region as a nucleus. Therefore, the cooling rate after the completion of hot rolling, that is, the average cooling rate from the completion of rough rolling to coiling is limited to 50° C./sec. or less. When the cooling rate after the completion of hot rolling is more than 50° C./sec., TiC is finely precipitated and therefore coarse TiC cannot be ensured. Incidentally, the cooling rate after the completion of hot rolling is preferably 40° C./sec. or less, more preferably 30° C./sec. or less, and further more preferably 20° C./sec. or less. The lower limit of the cooling rate after the completion of hot rolling need not be particularly limited and is preferably 10° C./sec. or more because slow cooling increases the thickness of scale to cause a reduction in yield.

Coiling temperature: 600° C. or higher

When the coiling temperature is low, precipitated carbides (TiC) are fine, the steel sheet is hard, the precipitation of carbides is insufficient, and C is present in the form of a solid solution. When solute C remains, the steel sheet has age-hardenablity. In order to avoid this phenomenon, the coiling temperature is 600° C. or higher. Incidentally, the coiling temperature is preferably 620° C. or higher and more preferably 650° C. or higher. The upper limit of the coiling temperature is not particularly limited and is preferably 750° C. in order to prevent surface defects due to scale.

The obtained hot-rolled sheet may be directly delivered as a product sheet (hot-rolled steel sheet) or may be processed into a cold-rolled annealed sheet (cold-rolled steel sheet) as required in such a way that the hot-rolled sheet is pickled, is cold-rolled, and is then recrystallized by annealing (soaking treatment).

Pickling may be performed in accordance with common practice. The rolling reduction (cold-rolling reduction) during cold rolling need not be particularly limited and is preferably 50% to 95% such that rolling can be performed in an ordinary cold rolling line. Since the diameter of the recrystallized ferrite grains tends to decrease with an increase in cold-rolling reduction, the cold-rolling reduction is preferably 90% or less. Since the texture develops with an increase in cold-rolling reduction to enhance the formability, the cold-rolling reduction is preferably 70% or more, more preferably 80% or more, and further more preferably 85% or more.

Furthermore, a cold-rolled sheet is recrystallized by soaking treatment (annealing), whereby the cold-rolled annealed sheet is obtained.

Soaking treatment temperature (soaking temperature): 650° C. to 850° C.

When the soaking (annealing) temperature is lower than 650° C., recrystallization does not occur sufficiently and therefore desired ductility cannot be ensured. However, at a temperature of higher than 850° C., TiC dissolves to form a solid solution again and thereby solute C remains, and the ferrite grains grow and thereby equiaxed grain growth (approaching polygonal ferrite) proceeds. Therefore, the ratio $d_L/d_t$ of the rolling-direction ferrite grain diameter to the thickness-wise ferrite grain diameter may possibly be less than 1.1. Therefore, the soaking treatment temperature (soaking temperature) preferably ranges from 650° C. to 850° C., more preferably 700° C. to 800° C., further more preferably 700° C. to 770° C., and particularly preferably 700° C. to 750° C.

Soaking time during soaking treatment: 10 s to 300 seconds

When the soaking time is less than 10 seconds, recrystallization is not completed and therefore the ductility is reduced. However, the soaking time is more than 300 seconds, the growth of the ferrite grains proceeds to cause equiaxed grain growth and therefore the ratio $d_L/d_t$ may possibly be less than 1.1. Therefore, the soaking time during soaking treatment preferably ranges from 10 s to 300 seconds, more preferably 30 seconds to 200 seconds, and further more preferably 60 seconds to 200 seconds.

The rate of heating to the soaking temperature during soaking treatment (annealing) need not be particularly limited. A heating rate of about 1° C./sec. to 50° C./sec., which is available in an ordinary apparatus such as a furnace, is not particularly problematic. The cooling rate after soaking treatment (annealing) also need not be particularly limited.

Incidentally, the steel sheet may be temper-rolled with an elongation of about 0.5% to 3% as required.

Furthermore, the steel sheet (hot-rolled or cold-rolled steel sheet) produced by the above method may be plated in order to enhance the corrosion resistance thereof. Plating used may be one selected from the group consisting of galvanizing, electrogalvanizing, Ni plating, Sn plating, Cr plating, and Al plating or alloy plating of them. After being plated, the steel sheet, which is a base, may be further subjected to diffusional alloy galvanizing by diffusion annealing in order to enhance the corrosion resistance thereof.

There is no problem if a chemical conversion coating, a resin coating, or the like is formed after plating.

Examples of the Invention

Steels having compositions shown in Table 1 were each produced in a converter and were then formed into steel materials (slabs with a thickness of 250 mm) by a continuous casting process. Incidentally, slab cracking occurred in steel containing 0.006% N and other components substantially the same as those of Steel No. 1; however, this is not shown in Table 1. The steel materials were heated to heating temperatures shown in Table 2 and were subjected to hot rolling including rough rolling and finish rolling under conditions shown in Table 2 and some of the resulting steel sheets were further pickled, were cold-rolled, and were then annealed (soaked), whereby steel sheets (hot-rolled steel sheets or cold-rolled steel sheets) with thicknesses shown in Table 2 were obtained. Incidentally, in the course of hot rolling, the steel materials were held in a range of 900° C. to 950° C. for 3 seconds or more. Furthermore, some of the steel sheets were temper-rolled under conditions (temper-rolling reduction) shown in Table 2. The $Ar_a$ transformation temperature was determined by the above-mentioned method.

Specimens were taken from the obtained steel sheets and were then subjected to microstructure observation, a tensile test, and an aging test. Test methods are as described below.

(1) Microstructure Observation

A specimen for microstructure observation was taken from each obtained steel sheet. A rolling-direction cross-section thereof was polished; was corroded with a corrosive liquid, nital, such that the microstructure was exposed; and was then observed with an optical microscope (a magnification of 100 times power).

In a thickness×1 mm region in the rolling-direction cross-section, the rolling-direction intercept length and thickness-wise intercept length of each ferrite grain were determined and the arithmetic means thereof were calculated, whereby the rolling-direction average intercept length and the thickness-wise average intercept length were determined. The rolling-direction average intercept length and the thickness-wise average intercept length were defined as the rolling-direction average ferrite grain diameter $d_L$ and the thickness-wise average ferrite grain diameter $d_t$, respectively. A value calculated from $d_L$ and $d_t$ by the formula $2/(1/d_L+1/d_t)$ was defined as the average ferrite grain diameter. Furthermore, the ratio $d_L/d_t$ was calculated from $d_L$ and $d_t$. The structural fraction (area percent) of ferrite in the microstructure was determined by image analysis on an area fraction (%) basis on the basis of a microstructure photograph taken in the thickness×1 mm region in the rolling-direction cross-section.

(2) Tensile Test

A JIS No. 5 tensile specimen was taken from each obtained steel sheet such that the tensile direction thereof coincided with the rolling direction. The tensile test was performed at a strain rate of 10 mm/min in accordance with JIS Z 2241, whereby tensile properties (yield point YP, tensile strength TS, and elongation El) were determined.

(3) Aging Test

A JIS No. 5 tensile specimen was taken from each obtained steel sheet such that the tensile direction thereof coincided with the rolling direction. After a pre-strain of 7.5% was applied to the tensile specimen, the tensile specimen was aged at 100° C. for 30 minutes. After aging, a tensile test was performed in accordance with JIS Z 2241, whereby the aged yield stress was determined. The difference (increment) between the aged yield stress and the 7.5% pre-strained strength (stress) was calculated, whereby AI (aging index) was determined. Furthermore, another JIS No. 5 tensile specimen was taken from the obtained steel sheet such that the tensile direction thereof coincided with the rolling direction. After this tensile specimen was aged at 50° C. for three months, a tensile test was performed at a strain rate of 10 mm/min, whereby the aged yield point YP was determined.

Obtained results are shown in Table 3.

TABLE 1

| Steel No. | Chemical components (mass percent) C | Si | Mn | P | S | Al | N | Ti | B | Nb, V, W, Mo, Cr | Ni, Cu | Ti*/C | Remarks |
|---|---|---|---|---|---|---|---|---|---|---|---|---|---|
| A | 0.021 | 0.01 | 0.1 | 0.01 | 0.01 | 0.04 | 0.002 | 0.10 | — | — | — | 4.4 | Adequate example |
| B | 0.021 | 0.01 | 0.1 | 0.01 | 0.01 | 0.03 | 0.002 | 0.09 | — | — | — | 4.0 | Adequate example |
| C | 0.015 | 0.03 | 0.3 | 0.03 | 0.02 | 0.02 | 0.003 | 0.10 | — | — | — | 6.0 | Adequate example |
| D | 0.022 | 0.03 | 0.1 | 0.01 | 0.02 | 0.02 | 0.004 | 0.11 | — | — | — | 4.4 | Adequate example |
| E | 0.025 | 0.01 | 0.2 | 0.01 | 0.01 | 0.05 | 0.003 | 0.12 | — | — | — | 4.4 | Adequate example |
| F | 0.030 | 0.01 | 0.1 | 0.01 | 0.01 | 0.05 | 0.004 | 0.15 | — | — | — | 4.5 | Adequate example |
| G | 0.025 | 0.02 | 0.3 | 0.02 | 0.02 | 0.04 | 0.003 | 0.15 | — | — | — | 5.6 | Adequate example |
| H | 0.020 | 0.01 | 0.3 | 0.01 | 0.03 | 0.03 | 0.002 | 0.20 | — | — | — | 9.7 | Adequate example |
| I | 0.022 | 0.02 | 0.2 | 0.02 | 0.01 | 0.05 | 0.005 | 0.11 | — | — | — | 4.2 | Adequate example |
| J | 0.015 | 0.03 | 0.3 | 0.03 | 0.03 | 0.02 | 0.003 | 0.07 | — | — | — | 4.0 | Adequate example |
| K | 0.025 | 0.05 | 0.2 | 0.20 | 0.01 | 0.01 | 0.002 | 0.14 | — | — | — | 5.3 | Adequate example |
| L | 0.022 | 0.04 | 0.5 | 0.15 | 0.01 | 0.10 | 0.005 | 0.15 | — | — | — | 6.0 | Adequate example |
| M | 0.025 | 0.01 | 1.0 | 0.10 | 0.02 | 0.06 | 0.001 | 0.20 | — | — | — | 7.9 | Adequate example |
| N | 0.022 | 0.02 | 1.5 | 0.03 | 0.10 | 0.02 | 0.004 | 0.50 | — | — | — | 22.1 | Adequate example |
| O | 0.025 | 0.09 | 2.0 | 0.02 | 0.05 | 0.05 | 0.003 | 0.40 | — | — | — | 15.6 | Adequate example |
| P | 0.035 | 0.02 | 0.1 | 0.01 | 0.02 | 0.08 | 0.001 | 0.33 | 0.0005 | Nb: 0.005, V: 0.005, W: 0.005, Mo: 0.005, Cr: 0.005 | Ni: 0.01, Cu: 0.01 | 9.3 | Adequate example |
| Q | 0.020 | 0.01 | 0.2 | 0.01 | 0.03 | 0.05 | 0.002 | 0.15 | 0.0010 | — | — | 7.2 | Adequate example |
| R | 0.025 | 0.02 | 0.3 | 0.02 | 0.01 | 0.02 | 0.002 | 0.11 | — | Nb: 0.01 | — | 4.1 | Adequate example |
| S | 0.035 | 0.01 | 0.2 | 0.01 | 0.01 | 0.03 | 0.003 | 0.20 | — | Nb: 0.005, Cr: 0.01 | — | 5.4 | Adequate example |
| T | 0.021 | 0.02 | 0.3 | 0.02 | 0.01 | 0.04 | 0.002 | 0.13 | — | Nb: 0.005, V: 0.005, W: 0.005, Mo: 0.005, Cr: 0.005 | — | 5.9 | Adequate example |
| U | 0.018 | 0.09 | 0.1 | 0.01 | 0.03 | 0.05 | 0.002 | 0.12 | — | — | Ni: 0.01 | 6.3 | Adequate example |
| V | 0.050 | 0.01 | 0.2 | 0.01 | 0.01 | 0.04 | 0.001 | 0.35 | — | — | — | 6.9 | Adequate example |
| W | 0.025 | 1.1 | 0.3 | 0.01 | 0.01 | 0.03 | 0.002 | 0.15 | — | — | — | 5.7 | Comparative example |
| X | 0.030 | 0.02 | 2.2 | 0.02 | 0.02 | 0.04 | 0.003 | 0.20 | — | — | — | 6.3 | Comparative example |
| Y | 0.055 | 0.01 | 0.5 | 0.01 | 0.03 | 0.05 | 0.001 | 0.30 | — | — | — | 5.4 | Comparative example |
| Z | 0.013 | 0.02 | 0.2 | 0.01 | 0.01 | 0.03 | 0.003 | 0.20 | — | — | — | 14.6 | Comparative example |
| AA | 0.030 | 0.02 | 0.2 | 0.22 | 0.01 | 0.02 | 0.002 | 0.15 | — | — | — | 4.8 | Comparative example |
| AB | 0.026 | 0.01 | 0.3 | 0.02 | 0.02 | 0.12 | 0.002 | 0.20 | — | — | — | 7.4 | Comparative example |
| AC | 0.020 | 0.02 | 0.2 | 0.01 | 0.01 | 0.05 | 0.003 | 0.55 | — | — | — | 27.0 | Comparative example |
| AD | 0.015 | 0.01 | 0.3 | 0.01 | 0.02 | 0.04 | 0.001 | 0.05 | — | — | — | 3.1 | Comparative example |
| AE | 0.015 | 0.02 | 0.1 | 0.02 | 0.01 | 0.03 | 0.005 | 0.06 | — | — | — | 2.9 | Comparative example |

Ti* = Ti-3.4 N

TABLE 2

| | | Hot rolling | | | | | | | | | Cold rolling | | Soaking annealing) | | | Temp-ering | | |
|---|---|---|---|---|---|---|---|---|---|---|---|---|---|---|---|---|---|---|
| Steel sheet No. | Steel No. | Ar3 (° C.) | Heating temperature (° C.) | Rough-rolling reduction (%) | Finishing temperature of rough rolling (° C.) | Holding time at 900° C. to 950° C. (sec.) | Finishing delivery temperature (° C.) | Average cooling rate after rolling (° C./sec.) | Coiling temperature (° C.) | Thickness (mm) | Cold-rolling reduction (%) | Thickness (mm) | Heating rate (° C./sec.) | Soaking temperature (° C.) | Soaking time (sec.) | Temper-rolling reduction (%) | Plating | Remarks |
| 1 | A | 850 | 1250 | 88 | 1050 | 10 | 880 | 20 | 650 | 3.0 | — | — | — | — | — | 0.5 | — | Example of present invention |
| 2 | B | 850 | 1200 | 88 | 1050 | 10 | 880 | 20 | 650 | 3.0 | 85 | 0.45 | 10 | 750 | 30 | 1.0 | Electro Ni | Example of present invention |
| 3 | C | 860 | 1230 | 80 | 1100 | 2 | 880 | 30 | 660 | 2.5 | 86 | 0.35 | 15 | 750 | 50 | 1.0 | — | Comparative example |
| 4 | D | 870 | 1220 | 89 | 1090 | 10 | 880 | 60 | 660 | 2.5 | — | — | — | — | — | 0.5 | — | Comparative example |
| 5 | E | 860 | 1200 | 86 | 1100 | 15 | 880 | 30 | 580 | 3.0 | 85 | 0.45 | 10 | 730 | 80 | 0.5 | — | Comparative example |
| 6 | E | 860 | 1200 | 86 | 1100 | 15 | 880 | 30 | 590 | 3.0 | 85 | 0.45 | 10 | 730 | 80 | 0.5 | — | Comparative example |
| 7 | F | 850 | 1200 | 80 | 1100 | 10 | 880 | 20 | 600 | 2.5 | 90 | 0.25 | 10 | 640 | 50 | 0.5 | — | Comparative example |
| 8 | G | 840 | 1210 | 85 | 1110 | 5 | 890 | 25 | 650 | 3.0 | 80 | 0.60 | 10 | 860 | 100 | 1.0 | — | Comparative example |
| 9 | H | 850 | 1220 | 85 | 1080 | 8 | 870 | 20 | 600 | 2.0 | 70 | 0.60 | 15 | 700 | 8 | 1.0 | — | Comparative example |
| 10 | I | 850 | 1260 | 80 | 1090 | 15 | 880 | 30 | 600 | 2.5 | 80 | 0.50 | 15 | 750 | 330 | 0.5 | — | Comparative example |
| 11 | J | 860 | 1250 | 80 | 1100 | 3 | 870 | 50 | 750 | 2.0 | 50 | 1.00 | 1.0 | 850 | 90 | 3.0 | Galvannealing | Example of present invention |
| 12 | K | 850 | 1220 | 85 | 1130 | 5 | 890 | 40 | 700 | 2.0 | — | — | — | — | — | 1.5 | — | Example of present invention |
| 13 | L | 870 | 1230 | 82 | 1100 | 10 | 880 | 30 | 600 | 2.5 | 70 | 0.75 | 3.0 | 790 | 120 | 2.0 | Galvanizing | Example of present invention |
| 14 | M | 840 | 1200 | 78 | 1080 | 30 | 860 | 30 | 620 | 2.5 | — | — | — | — | — | 1.0 | — | Example of present invention |
| 15 | N | 830 | 1150 | 83 | 1030 | 15 | 860 | 10 | 650 | 2.0 | 80 | 0.40 | 50 | 800 | 300 | — | Alloy electro Ni | Example of present invention |
| 16 | O | 800 | 1280 | 90 | 1150 | 10 | 830 | 15 | 680 | 2.5 | 80 | 0.50 | 30 | 770 | 200 | 0.5 | — | Example of present invention |
| 17 | P | 830 | 1210 | 87 | 1080 | 8 | 870 | 30 | 650 | 4.0 | 95 | 0.20 | 15 | 700 | 100 | 1.0 | — | Example of present invention |
| 18 | Q | 850 | 1220 | 86 | 1090 | 7 | 880 | 35 | 680 | 2.0 | 85 | 0.30 | 20 | 650 | 50 | 0.5 | — | Example of present invention |
| 19 | R | 850 | 1260 | 83 | 1160 | 10 | 870 | 25 | 640 | 2.5 | 86 | 0.35 | 10 | 680 | 20 | 0.5 | — | Example of present invention |
| 20 | S | 830 | 1230 | 85 | 1090 | 6 | 850 | 20 | 650 | 3.5 | 90 | 0.35 | 10 | 730 | 180 | 1.0 | — | Example of present invention |
| 21 | T | 850 | 1200 | 86 | 1070 | 4 | 890 | 45 | 660 | 2.0 | 70 | 0.60 | 25 | 750 | 100 | 0.5 | — | Example of present invention |
| 22 | U | 880 | 1150 | 83 | 1020 | 5 | 890 | 30 | 650 | 2.5 | 80 | 0.50 | 20 | 760 | 60 | 1.0 | — | Example of present invention |
| 23 | V | 830 | 1120 | 85 | 1050 | 10 | 870 | 35 | 630 | 1.5 | 80 | 0.30 | 10 | 770 | 10 | 0.5 | Electro Zn | Example of present invention |
| 24 | W | 910 | 1180 | 86 | 1060 | 15 | 900 | 30 | 620 | 2.5 | 80 | 0.50 | 10 | 750 | 30 | 1.0 | — | Comparative example |
| 25 | X | 810 | 1200 | 83 | 1070 | 10 | 850 | 25 | 650 | 2.0 | — | — | — | — | — | 1.0 | — | Comparative example |
| 26 | Y | 810 | 1210 | 81 | 1100 | 3 | 830 | 20 | 630 | 2.5 | 80 | 0.50 | 15 | 730 | 100 | 0.5 | — | Comparative example |
| 27 | Z | 880 | 1220 | 80 | 1080 | 5 | 890 | 40 | 660 | 3.0 | 85 | 0.45 | 20 | 700 | 120 | 0.5 | — | Comparative example |
| 28 | AA | 910 | 1210 | 85 | 1120 | 10 | 900 | 25 | 680 | 3.5 | — | — | — | — | — | 1.0 | — | Comparative example |
| 29 | AB | 910 | 1200 | 83 | 1110 | 15 | 900 | 25 | 700 | 3.0 | — | — | — | — | — | 1.0 | — | Comparative example |
| 30 | AC | 920 | 1230 | 78 | 1070 | 5 | 900 | 10 | 600 | 4.0 | 75 | 1.00 | 10 | 830 | 150 | 1.0 | — | Comparative example |
| 31 | AD | 860 | 1210 | 88 | 1080 | 6 | 870 | 50 | 630 | 2.5 | 80 | 0.50 | 15 | 800 | 50 | 0.5 | — | Comparative example |
| 32 | AE | 860 | 1200 | 87 | 1050 | 8 | 880 | 45 | 650 | 3.0 | 80 | 0.60 | 10 | 750 | 60 | 1.0 | — | Comparative example |

TABLE 3

| Steel sheet No. | Steel No. | Microstructure: Ferrite fraction (area percent) | Microstructure: Average ferrite grain diameter (μm)* | $d_L/d_t$ | Tensile properties: YP (MPa) | Tensile properties: TS (MPa) | Tensile properties: El (%) | Aging resistance property: AI (MPa) | Aging resistance property: Yield point YP after aging** (MPa) | Remarks |
|---|---|---|---|---|---|---|---|---|---|---|
| 1 | A | 100 | 15 | 1.3 | 240 | 340 | 45 | 1 | 260 | Example of present invention |
| 2 | B | 100 | 10 | 1.2 | 260 | 360 | 40 | 0 | 270 | Example of present invention |
| 3 | C | 100 | 6 | 1.0 | 380 | 410 | 30 | 11 | 410 | Comparative example |
| 4 | D | 100 | 7 | 1.0 | 370 | 420 | 28 | 12 | 420 | Comparative example |
| 5 | E | 100 | 6 | 1.0 | 380 | 420 | 31 | 11 | 420 | Comparative example |
| 6 | E | 100 | 7 | 1.0 | 380 | 420 | 31 | 9 | 410 | Comparative example |
| 7 | F | 100 | 6 | 1.0 | 390 | 410 | 33 | 12 | 410 | Comparative example |
| 8 | G | 100 | 15 | 1.0 | 370 | 420 | 34 | 13 | 410 | Comparative example |
| 9 | H | 100 | 6 | 1.0 | 400 | 440 | 32 | 15 | 430 | Comparative example |
| 10 | I | 100 | 15 | 0.9 | 380 | 450 | 30 | 18 | 440 | Comparative example |
| 11 | J | 100 | 30 | 2.0 | 230 | 330 | 48 | 1 | 250 | Example of present invention |
| 12 | K | 100 | 15 | 1.5 | 250 | 320 | 45 | 2 | 260 | Example of present invention |
| 13 | L | 100 | 12 | 1.2 | 260 | 330 | 45 | 1 | 270 | Example of present invention |
| 14 | M | 100 | 12 | 1.2 | 300 | 340 | 45 | 5 | 330 | Example of present invention |
| 15 | N | 100 | 10 | 1.1 | 350 | 410 | 38 | 10 | 380 | Example of present invention |
| 16 | O | 100 | 11 | 1.2 | 290 | 330 | 44 | 8 | 320 | Example of present invention |
| 17 | P | 100 | 9 | 1.1 | 320 | 350 | 43 | 5 | 350 | Example of present invention |
| 18 | Q | 100 | 7 | 1.1 | 280 | 300 | 46 | 3 | 300 | Example of present invention |
| 19 | R | 100 | 10 | 1.2 | 280 | 350 | 43 | 0 | 280 | Example of present invention |
| 20 | S | 98 | 12 | 1.2 | 260 | 330 | 42 | 0 | 260 | Example of present invention |
| 21 | T | 100 | 13 | 1.3 | 230 | 300 | 50 | 0 | 230 | Example of present invention |
| 22 | U | 100 | 15 | 1.3 | 280 | 350 | 43 | 5 | 310 | Example of present invention |
| 23 | V | 95 | 8 | 1.1 | 290 | 360 | 45 | 6 | 320 | Example of present invention |
| 24 | W | 100 | 11 | 1.0 | 380 | 430 | 33 | 12 | 420 | Comparative example |
| 25 | X | 100 | 15 | 1.0 | 400 | 450 | 31 | 12 | 430 | Comparative example |
| 26 | Y | 93 | 10 | 1.0 | 380 | 430 | 30 | 15 | 420 | Comparative example |
| 27 | Z | 100 | 25 | 0.9 | 380 | 430 | 32 | 20 | 430 | Comparative example |
| 28 | AA | 100 | 15 | 1.0 | 370 | 450 | 33 | 15 | 430 | Comparative example |
| 29 | AB | 100 | 8 | 0.9 | 380 | 430 | 32 | 13 | 410 | Comparative example |
| 30 | AC | 100 | 10 | 1.0 | 390 | 420 | 30 | 11 | 410 | Comparative example |
| 31 | AD | 100 | 13 | 1.0 | 370 | 420 | 32 | 12 | 420 | Comparative example |
| 32 | AE | 100 | 12 | 1.0 | 360 | 410 | 32 | 11 | 410 | Comparative example |

*Average ferrite grain diameter = $2/(1/d_L + 1/d_t)$ $d_L$: rolling-direction average ferrite grain diameter (μm), $d_t$: thickness-wise average ferrite grain diameter (μm)
**Aging: at 50° C. for 3 months All examples of the present invention show an AI (aging index) of less than 10 MPa and an aged yield stress (yield point) of 400 MPa or less and provide steel sheet having excellent an aging resistance property. However, comparative examples which are outside the scope of the present invention show an aged yield stress of more than 400 MPa and a large AI (aging index) of more than 10 MPa; hence, it is clear that the aging resistance property is reduced. Even a steel sheet produced under such conditions that TiC cannot be sufficiently precipitated in a γ-region may possibly has an AI of 10 MPa or less because conditions for subsequent precipitation are appropriate (Steel Sheet No. 6). Even in this case, it is clear that the ratio $d_L/d_t$ is not 1.1 or more and the aged yield stress is more than 400 MPa.

The invention claimed is:

1. A steel sheet with an excellent aging resistance property, having a composition containing 0.015% to 0.05% C, less than 0.10% Si, 0.1% to 2.0% Mn, 0.20% or less P, 0.1% or less S, 0.01% to 0.10% Al, 0.005% or less N, and 0.06% to 0.5% Ti in percent by mass, the remainder comprising Fe and inevitable impurities, C and Ti satisfying the following inequality (1); the steel sheet having a microstructure which contains a ferrite phase as a base, in which the average grain diameter of the ferrite phase is 7 μm or more, and in which the ratio $d_L/d_t$ of the rolling-direction average grain diameter $d_L$ to thickness-wise average grain diameter $d_t$ of the ferrite phase is 1.1 or more; the steel sheet having an aged yield stress of 400 MPa or less after aging at a temperature of 50° C. for 3 months, the steel sheet having a rolling-direction AI (aging index) value of 10 MPa or less, the rolling-direction AI value being defined as a value which is obtained in such a way that after a tensile specimen is taken such that a rolling direction coincides with a tensile direction, a pre-strain of 7.5% is applied to the tensile specimen to measure a stress, and the tensile specimen is aged at 100° C. for 30 minutes, the measured stress of the 7.5% pre-strain is subtracted from the yield stress of the aged specimen:

$$Ti^*/C \geq 4 \quad (1)$$

where $Ti^* = Ti - 3.4N$ and Ti, C, and N represent the content (mass percent) of each element.

2. The steel sheet according to claim 1, further containing 0.0005% to 0.0050% B in percent by mass in addition to the above composition.

3. The steel sheet according to claim 1, further containing at least one selected from the group consisting of 0.005% to 0.1% Nb, 0.005% to 0.1% V, 0.005% to 0.1% W, 0.005% to 0.1% Mo, and 0.005% to 0.1% Cr in percent by mass in addition to the above composition.

4. The steel sheet according to claim 1, further containing at least one selected from the group consisting of 0.01% to 0.1% Ni and 0.01% to 0.1% Cu in percent by mass in addition to the above composition.

5. The steel sheet according to claim 1 being a thin steel sheet with a thickness of 0.5 mm or less.

6. The steel sheet according to claim 1, comprising a surface plating layer.

7. The steel sheet according to claim 2, further containing at least one selected from the group consisting of 0.005% to OA % Nb, 0.005% to 0.1% V, 0.005% to 0.1% W, 0.005% to 0.1% Mo, and 0.005% to 0.1% Cr in percent by mass in addition to the above composition.

8. The steel sheet according to claim 2, further containing at least one selected from the group consisting of 0.01% to 0.1% Ni and 0.01% to 0.1% Cu in percent by mass in addition to the above composition.

9. The steel sheet according to claim 3, further containing at least one selected from the group consisting of 0.01% to 0.1% Ni and 0.01% to 0.1% Cu in percent by mass in addition to the above composition.

10. The steel sheet according to claim 7, further containing at least one selected from the group consisting of 0.01% to 0.1% Ni and 0.01% to 0.1% Cu in percent by mass in addition to the above composition.

* * * * *